US005317471A

United States Patent [19]

Izoard et al.

[11] Patent Number: 5,317,471

[45] Date of Patent: May 31, 1994

[54] PROCESS AND DEVICE FOR SETTING A THERMAL TRIP DEVICE WITH BIMETAL STRIP

[75] Inventors: Jean Izoard, Bresson; M. Eric Menegaz, Villard-Bonnot; Jean-Louis Drillat, Les Marches; Philippe Le Maitre, Grenoble, all of France

[73] Assignee: Gerin Merlin, France

[21] Appl. No.: 969,979

[22] Filed: Nov. 2, 1992

[30] Foreign Application Priority Data

Nov. 13, 1991 [FR] France ..... 91 14197

[51] Int. Cl.[5] ..... H01H 71/16

[52] U.S. Cl. ..... 361/105; 324/417; 335/45; 337/82

[58] Field of Search ..... 361/105, 103; 335/45, 335/43, 44; 337/82; 29/756, 622; 324/417

[56] References Cited

U.S. PATENT DOCUMENTS 3,908,110 9/1975 Heft ..... 29/756
3,944,959 3/1976 Kidd ..... 337/82
3,953,812 4/1976 Heft et al. ..... 335/23

FOREIGN PATENT DOCUMENTS 1204498 1/1960 France .

*Primary Examiner*—A. D. Pellinen
*Assistant Examiner*—Sally C. Medley
*Attorney, Agent, or Firm*—Parkhurst, Wendel & Rossi

[57] ABSTRACT

A thermal setting process of the bimetal strip consists in securing an adjusting pin to the trip bar by means of laser welding when the bimetal strip reaches a first preset temperature, and then checking tripping at a second temperature with or without action on a positioning screw of the bar.

16 Claims, 3 Drawing Sheets

PROCESS AND DEVICE FOR SETTING A THERMAL TRIP DEVICE WITH BIMETAL STRIP

BACKGROUND OF THE INVENTION

The invention relates to a process for setting a thermal trip device with bimetal strip, notably for an electrical circuit breaker, consisting in positioning the bimetal strip in relation to an adjusting pin of a trip bar, following input of a setting current of an intensity greater than that of the rated current.

There are a multitude of environmentally linked constructional parameters liable to influence the behaviour of a thermal trip device with bimetal strip. The cumulated sum of the tolerances generated by these parameters can be greater than the tripping range imposed by the standard, which specifies that tripping must take place between 1.05In and 1.3In after one hour (In being the rated current).

Factory setting serves the purpose of minimizing the influence of these parameters, and consists in fixing the relative positions of the bimetal strip with respect to the tripping basis.

A state-of-the-art factory setting method consists in applying a monitoring current of 3In for a preset fixed time. An adjustment screw then enables the foot of the bimetal strip to be deformed to trip the circuit breaker.

Another state-of-the-art method uses a wedge, which after the current has been applied for a fixed time, is secured to the bar by means of a glue sensitive to ultraviolet radiation. Polymerization of the glue takes several seconds, during which period it is indispensable to immobilize the position of the bimetal strip in relation to the trip bar. The time taken by such a setting cycle is very long, which constitutes a drawback when setting is carried out on an automatic production line.

In these prior art methods, monitoring of the initial position of the bimetal strip is based exclusively on the current flow during a given time.

A first object of the invention consists in improving the factory setting process of a thermal trip device in order to overcome all the external or constructional factors of influence.

SUMMARY OF THE INVENTION

The process according to the invention is characterized by the following stages:

after the adjusting pin has been inserted with clearance inside an orifice of the bar in a zone situated facing the bimetal strip, the setting current IR is applied to cause deflection of the bimetal strip, driving the pin inside the orifice, whereas the trip bar remains immobile, the temperature increase of the bimetal strip is measured during the application of the setting current, the pin is immobilized in the orifice of the bar in an optimum position, when the measured temperature reaches a first preset value.

Securing of the adjusting pin in the orifice is performed by laser welding carried out simultaneously on all the poles.

The checking implemented by this process is based on the temperature, which reacts directly on the deflection of the bimetal strip. Laser welding is carried out almost instantaneously when the pin is in its optimum position. Laser welding makes it possible to work on-the-fly, which is favorable to reducing the setting cycle time. Factory setting can easily be carried out automatically at the end of the production line.

The current is maintained after the adjusting pin has been immobilized by the laser, and the tripping action is checked when the temperature of the bimetal strip 12 reaches a second preset value a2.

According to a development of the process, a servocontrol device is used and is controlled by the temperature of the bimetal strip to modify the setting of a positioning screw of the bar, so as to bring about tripping for the second temperature value. After setting, the screw is locked in its support.

A second object of the invention consists in achieving a setting device for implementation of the process. Measurement of the temperature of the bimetal strip is performed in real time by means of an infrared pyrometer coupled to an electronic circuit, notably of a programmable controller, for control of a laser and/or of the servocontrol device of the positioning screw of the bar.

The electronic circuit comprises control means actuated by the output signal of the pyrometer, compared with a first and a second reference signal S1, S2, which are exceeded at the times t2 and t4 when the temperature of the bimetal strip reaches respectively the first and second values.

A third object consists in providing a thermal trip device with bimetal strip equipped with means for reliable factory setting.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
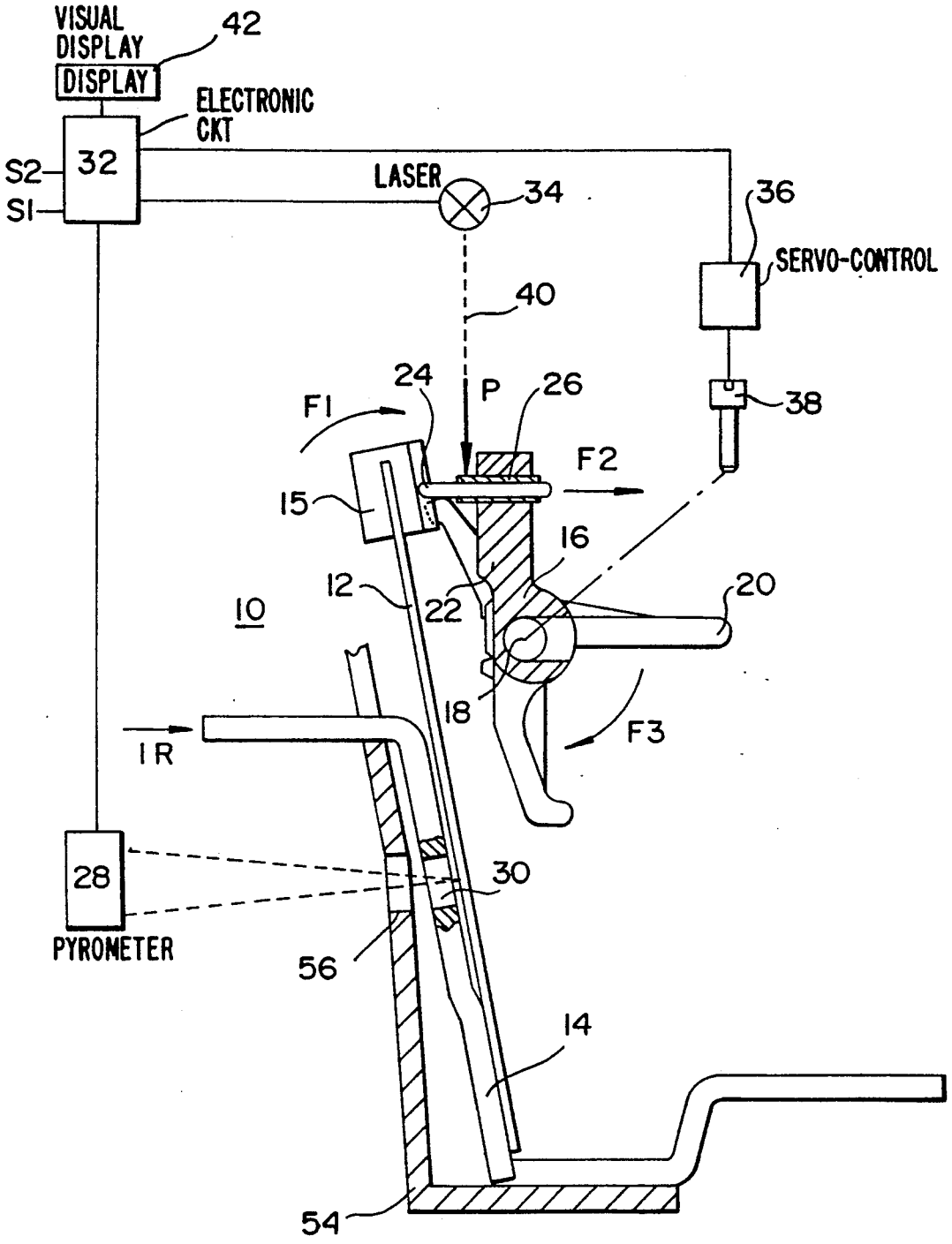
FIG. 1 shows a schematic view of implementation of the setting process according to the invention.
Figure 2:
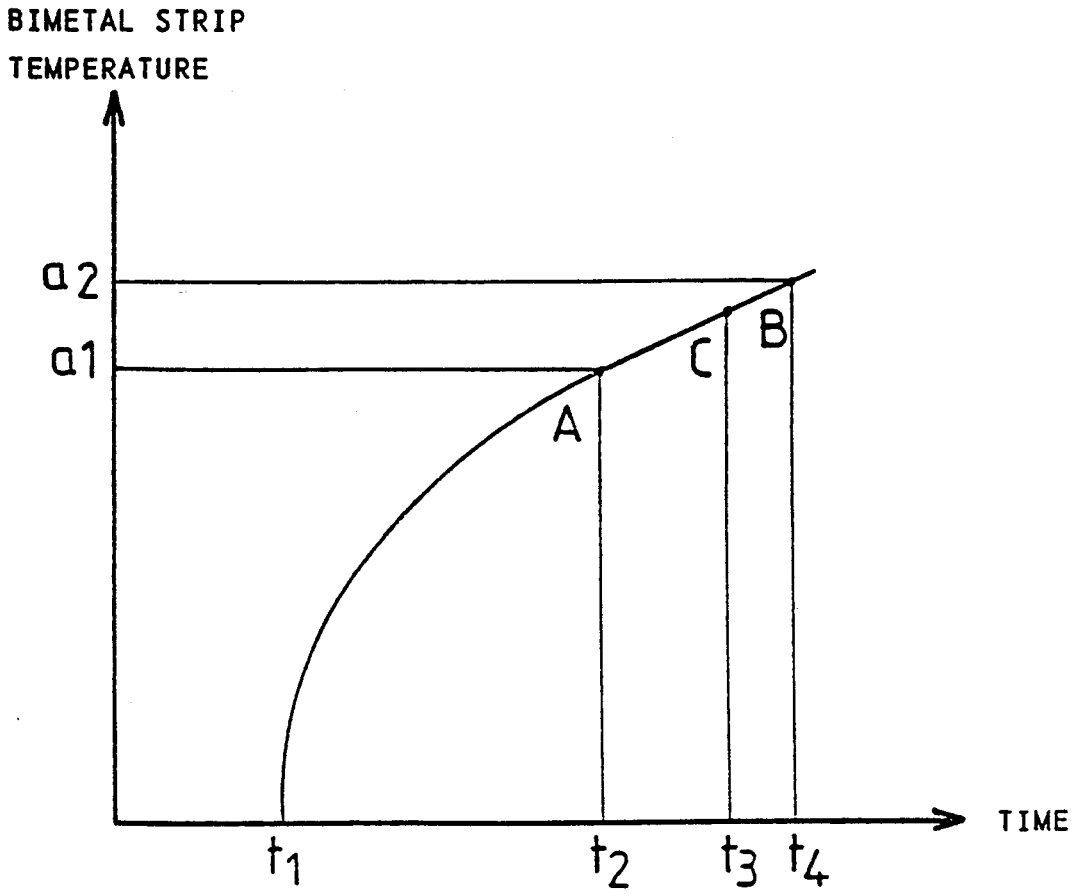
FIG. 2 represents the diagram of the temperature of the bimetal strip versus time in the course of a thermal setting cycle.

In FIGS. 1 and 2, a thermal trip device 10 of a multipole circuit breaker comprises in each pole a bimetal strip 12 associated with a heater 14 in which the current flows. A cap 15 provided at the end of the bimetal strip 12 is designed to cooperate with a trip bar 16 mounted with limited rotation around a spindle 18. In the event of deflection of the bimetal strip 12 in the direction of the arrow F1 following the appearance of an overload current, the trip bar 16 turns in the clockwise direction indicated by the arrow F3, and brings about unlocking of the operating mechanism (not represented) resulting in opening of the circuit breaker contacts. The bar 16 comprises a first latching arm 20 cooperating with the ratchet lock (not represented), and a second positioning arm 22 equipped with an adjusting pin 24, which comes into engagement with the cap 15 of the bimetal strip 12.

When the circuit breaker is assembled, the adjusting pin 24 is inserted with sliding in a guide tube 26 securedly united to the positioning arm 22 of the bar 16. The tube 26 and pin 24, made of metallic material, for example steel, are separated from one another by a minimal clearance. The axial length of the pin 24 is greater than that of the tube 26, which protrudes out on both sides of the second arm 22.

To minimize the influence of the constructional and environmentally linked parameters influencing the behaviour of the thermal trip device 10, a factory setting consists in fixing the positioning of the bimetal strip 12 in relation to the tripping parts when the adjusting pin 24 reaches an optimum position. The pin 24 is then immobilized in the tube 26 by means of the process according to the invention.

The setting process of the thermal trip device 10 is as follows:

At a time t1, a setting current IR having an intensity greater than the rated current In, for example 3 to 5 In, is applied to the pole. The setting current IR flowing in the heater 14 causes heating of the foot of the bimetal strip 12, followed by deflection of the end 15 in the direction of the arrow F1. The movement of the bimetal strip 12 pushes the pin 24 inside the tube 26 in the direction of the arrow F2, whereas the trip bar 16 and tube 26 remain immobile.

During the translation travel of the pin 24, an infrared pyrometer 28 measures in real time the temperature of the foot of the bimetal strip 12 via a hole 30 in the heater 14. The pyrometer 28 compares the measured temperature with a first reference threshold S1 stored in an electronic circuit 32, notably of a controller commanding a laser 34 and a servocontrol device 36. An adjustment screw extending transversely to the bar 16 is controlled automatically by the servocontrol device 36.

At the time t2, the bimetal strip 12 reaches the temperature a1 corresponding to the value of the first reference threshold S1. The electronic circuit 32 orders energization of the laser 34, which sends a pulsed laser beam 40 in the direction of the tube 26 (arrow p). The impact of the laser beam 40 on the external surface of the tube 26 causes local fusion of the metal resulting in welding of the tube 26 and pin 24. This results in immobilization of the adjusting pin 24 in translation inside the tube 26.

The setting current IR is maintained beyond the time t2, and continues to heat the bimetal strip 12. Blocking of the pin 24 generates a buttressing effect of the bimetal strip 12, which is translated by a clockwise rotational movement of the bar 16 (arrow F3). The pyrometer 28 compares the temperature of the bimetal strip 12 with a second reference threshold S2, and the electronic circuit 32 checks that the tripping action takes place at the time t4 (point B, FIG. 2) and at the temperature a2, called the tripping temperature. The tripping temperature a2 is displayed on a display device 42 built into the control desk. It can be noted that the setting current IR is maintained until tripping takes place, with monitoring of the tripping temperature a2.

According to a development of the process, and depending on the value of the temperature measured by the pyrometer 28, the electronic circuit 32 is able to trigger operation of the servocontrol device 36 of the centralized adjustment screw 38 of the trip device. The servocontrol device 36 is put into operation at the time t3 (point C), slightly before the tripping time t4.

This results in a movement of the bar 16 in translation, modifying the actuation travel of the bimetal strip 12, to bring about tripping at the time t4 and at temperature a2. After adjustment, the screw 38 is locked in its support.

This setting method of the thermal trip device 10 is based on the temperature of the bimetal strip 12, and not on the current. A simple modification of the software of the electronic circuit 32 enables a solution to be selected with or without operation of the servocontrol device 36.

Laser welding enables almost instantaneous immobilization of the adjusting pin 24 to be obtained in its optimum position, and at a very precise time t2.

The reduced time of the setting cycle enables adjustment of the thermal trip device to be carried out directly at the end of the automatic production line.

Figure 3:
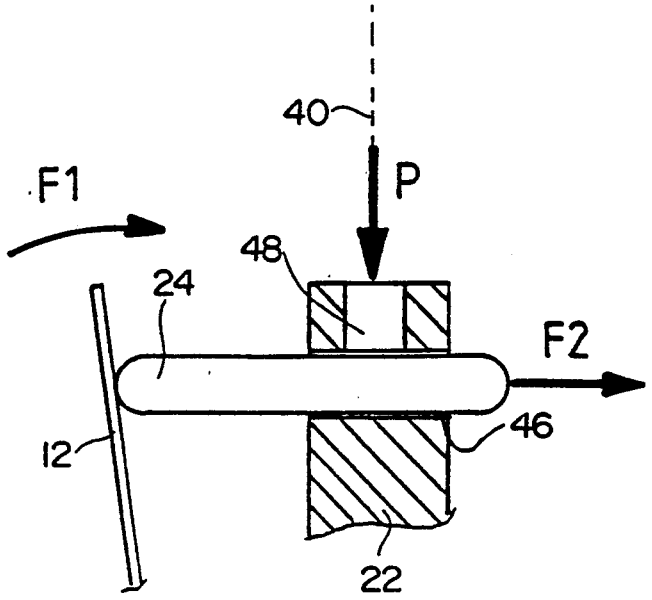
FIG. 3 illustrates a partial view of FIG. 1 of an alternative embodiment.
Figure 4:
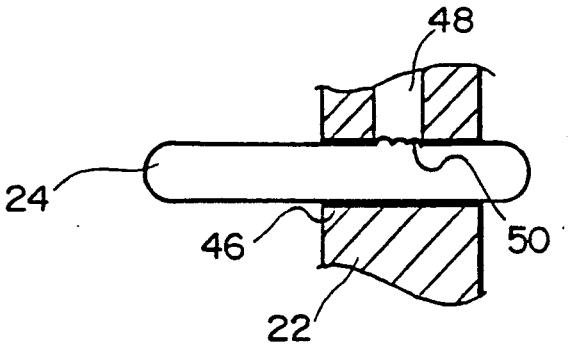
FIG. 4 shows an enlarged view of a part of FIG. 3, after laser welding.

In an alternative embodiment in FIGS. 3 and 4, the steel adjusting pin 24 is inserted directly in a bore 46 of the insulating arm 22 of the bar 16. The laser beam 40 bombards the pin 24 via an orthogonal orifice 48 made of plastic material. The metal in fusion is channelled towards the orifice 48 to form a stop 50 of the pin 24 in both rotation and translation.

The thermal setting method according to FIGS. 1 to 4 is also applicable to a thermal trip device having a bimetal strip which is directly heated.

During the setting operation the circuit breaker is advantageously positioned so that the pin 24 is directed vertically downwards bearing on the end 15 of the bimetal strip 12 by the effect of gravity.

The insulating case 54 of the circuit breaker comprises a hole 56 facing the bimetal strip 12 of each pole to enable the passage of the infrared beam of the pyrometer 28.

We claim:

1. A process for setting a thermal trip device, comprising the steps of;

inserting an adjusting pin into an orifice of a trip bar such that said adjusting pin is slidable therein;

heating a bimetal strip via application of a setting current such that said bimetal strip is deflected, said bimetal strip being positioned opposite said adjusting pin so as to contact and drive said adjusting pin in said orifice;

measuring the temperature of the bimetal strip during application of said setting current; and immobilizing said adjusting pin in said orifice at an optimum position when the temperature of said bimetal strip reaches a first preset value.

2. The process of claim 1, wherein said adjusting pin is immobilized by laser welding.

3. The process of claim 1, wherein application of the setting current is maintained after immobilizing said adjusting pin such that said bimetal strip drives said trip bar to a tripped position.

4. The process of claim 3, wherein the temperature of the bimetal strip is displayed on a display device.

5. The process of claim 3, further comprising the step of adjusting said trip bar such that the tripping takes place at a temperature according to a second preset value.

6. The process of claim 5, wherein the temperature of the bimetal strip is measured by an infrared pyrometer, said infrared pyrometer being coupled to an electronic circuit which controls said adjusting step.

7. The process of claim 5, wherein a servocontrol device controlled by the temperature of the bimetal strip is utilized to adjust said trip bar, a set screw setting the position of said trip bar.

8. The process of claim 7, wherein the servocontrol device is initiated after immobilizing said adjusting pin.

9. The process of claim 1, wherein the temperature of the bimetal strip is measured by an infrared pyrometer, said infrared pyrometer being coupled to an electrical circuit.

10. The process of claim 9, wherein said electrical circuit controls said immobilizing step.

11. An adjustable thermal trip device for an electronic circuit breaker, comprising;

a bimetal strip;

a rotary trip bar positioned with respect to the bimetal strip such that deflection of said bimetal strip due to an overload current drives said rotary trip bar to a tripped position, said rotary trip bar comprising a latching arm for latching with a lock, and a positioning arm;

an adjusting pin disposed within an orifice in said positioning arm, said bimetal strip coming into contact with said adjusting pin during an overload current flow, wherein said adjusting pin is immobilized within said orifice at an optimum position by a weld.

12. The device of claim 11, further comprising a tube in said orifice of said positioning arm, said adjusting pin slidably passing through said tube, said tube being secured to said positioning arm.

13. The device of claim 12, wherein the length of the tube is less than the length of the adjusting pin.

14. The device of claim 12, wherein said adjusting pin and said tube are comprised of metal.

15. The device of claim 12, wherein a gap is present between said tube and said adjusting pin.

16. The device of claim 11, further comprising an outer casing, said outer casing having a hole therein for passage of an infrared beam therethrough so as to detect the temperature of the bimetal strip.

* * * * *

UNITED STATES PATENT AND TRADEMARK OFFICE

CERTIFICATE OF CORRECTION

PATENT NO. : 5,317,471

DATED : May 31, 1994

INVENTOR(S) : Izoard et al.

It is certified that error appears in the above-identified patent and that said Letters Patent is hereby corrected as shown below:

On the title page, item [73] change "Gerin Merlin" to --Merlin Gerin--.

Signed and Sealed this

Sixteenth Day of August, 1994

*Attest:*

*Attesting Officer*

BRUCE LEHMAN

*Commissioner of Patents and Trademarks*